US009202423B2

(12) United States Patent
Sun et al.

(10) Patent No.: US 9,202,423 B2
(45) Date of Patent: Dec. 1, 2015

(54) LCD DEVICE, DRIVING METHOD OF LCD PANEL, AND MURA COMPENSATING METHOD

(71) Applicant: SHENZHEN CHINA STAR OPTOELECTRONICS TECHNOLOGY CO., LTD, Shenzhen (CN)

(72) Inventors: Lei Sun, Shenzhen (CN); Yu yeh Chen, Shenzhen (CN); Xiaoping Tan, Shenzhen (CN)

( * ) Notice: Subject to any disclaimer, the term of this patent is extended or adjusted under 35 U.S.C. 154(b) by 76 days.

(21) Appl. No.: 14/112,035

(22) PCT Filed: Sep. 10, 2013

(86) PCT No.: PCT/CN2013/083171
§ 371 (c)(1),
(2) Date: Oct. 16, 2013

(87) PCT Pub. No.: WO2015/032104
PCT Pub. Date: Mar. 12, 2015

(65) Prior Publication Data

US 2015/0062203 A1 Mar. 5, 2015

(30) Foreign Application Priority Data

Sep. 3, 2013 (CN) ..... 2013 1 0396431

(51) Int. Cl.
*G09G 3/36* (2006.01)
*G09G 3/20* (2006.01)

(52) U.S. Cl.
CPC ..... *G09G 3/3611* (2013.01); *G09G 3/2044* (2013.01); *G09G 2320/0233* (2013.01); *G09G 2320/0626* (2013.01)

(58) Field of Classification Search
CPC ..... G09G 2320/0223; G09G 2320/0626
USPC ..... 345/87, 89, 95, 98, 100, 101, 690–699
See application file for complete search history.

(56) References Cited

U.S. PATENT DOCUMENTS

| | | | | |
|---|---|---|---|---|
| 2006/0109221 | A1* | 5/2006 | Park | 345/88 |
| 2007/0126975 | A1* | 6/2007 | Choi et al. | 349/192 |
| 2008/0001869 | A1 | 1/2008 | Chung et al. | |
| 2008/0068324 | A1 | 3/2008 | Chung et al. | |
| 2008/0111782 | A1* | 5/2008 | Shin et al. | 345/99 |

FOREIGN PATENT DOCUMENTS

| | | | |
|---|---|---|---|
| CN | 1967636 | A | 5/2007 |
| CN | 1979603 | A | 6/2007 |
| CN | 101325024 | A | 12/2008 |

(Continued)

OTHER PUBLICATIONS

Jiang Yingting, the International Searching Authority written comments, Apr. 2014, CN.

*Primary Examiner* — Ram Mistry

(57) ABSTRACT

A method for driving a liquid crystal display (LCD) panel includes: driving the LCD panel according to a location of a pixel of the LCD panel and a corresponding compensation value of the pixel of the LCD panel. The compensation value of the pixel corresponds to an offset value of a reference brightness corresponding to brightness of a light spot of the LCD panel before compensation of the light spot of the LCD panel.

3 Claims, 6 Drawing Sheets

(56) References Cited

FOREIGN PATENT DOCUMENTS

| | | | |
|---|---|---|---|
| CN | 101354872 | A | 1/2009 |
| CN | 101599244 | A | 12/2009 |
| CN | 101685615 | A | 3/2010 |
| CN | 101996597 | A | 3/2011 |
| JP | 3110340 | B2 | 11/2000 |
| TW | 200923873 | A | 3/2010 |

* cited by examiner

| Address (LLCA) | Offset (OC_R) | Offset (OC_G) | Offset (OC_B) | Offset (Dither_R) | Offset (Dither_G) | Offset (Dither_B) |
|---|---|---|---|---|---|---|
| 0 | 0 | 0 | 0 | 0 | 0 | 0 |
| 1 | 0 | 0 | 0 | 0 | 0 | 0 |
| 2 | 0 | 0 | 0 | 0 | 0 | 0 |
| ... | ... | ... | ... | ... | ... | ... |
| 6 | 2 | 2 | 2 | 0 | 0 | 0 |
| ... | ... | ... | ... | ... | ... | ... |
| 38 | 3 | 3 | 3 | 1 | 1 | 1 |
| ... | ... | ... | ... | ... | ... | ... |
| 1277 | 0 | 0 | 0 | 0 | 0 | 0 |
| 1278 | 0 | 0 | 0 | 0 | 0 | 0 |
| 1279 | 0 | 0 | 0 | 0 | 0 | 0 |

| Pixel location | Gray scale | Address (LLCA) |
|---|---|---|
| 1 | 0 | 0 |
| | 8 | 1 |
| | 16 | 2 |
| | 24 | 3 |
| | 32 | 4 |
| | 40 | 5 |
| | 48 | 6 |
| | ... | ... |
| | 248 | 31 |
| | 0 | 32 |
| | 8 | 33 |
| | 16 | 34 |
| | 24 | 35 |
| | 32 | 36 |
| | 40 | 37 |
| | 48 | 38 |
| | ... | ... |
| | 248 | 63 |
| 3 | ... | ... |
| ... | ... | ... |
| 40 | ... | ... |

FIG. 8

LCD DEVICE, DRIVING METHOD OF LCD PANEL, AND MURA COMPENSATING METHOD

TECHNICAL FIELD

The present disclosure relates to the field of liquid crystal displays (LCDs), and more particularly to an LCD device, a method for driving an LCD panel, and a method for compensating light spot.

BACKGROUND

Exposure is an important in a manufacturing process of a thin film transistor (TFT). In manufacturing a large size liquid crystal display (LCD) panel, because size of an exposure machine is limited, the LCD panel is exposed by a partition. Thus, banded and uneven light spot is generated at a boundary of an exposure area (as shown in FIG. 1), and the light spot causes an uneven picture, which affects display quality of the LCD panel.

SUMMARY

In view of the above-described problems, the aim of the present disclosure is to provide a liquid crystal display (LCD) device, a method for driving an LCD panel, and a method for compensating light spot capable of reducing light spot of the LCD panel.

The aim of the present disclosure is achieved by the following methods.

A method for driving a liquid crystal display (LCD) panel comprises:

driving the LCD panel according to a location of a pixel of the LCD panel and a corresponding compensation value of the pixel of the LCD panel. The compensation value of the pixel corresponds to an offset value of a reference brightness corresponding to brightness of the light spot of the LCD panel before compensation of the light spot of the LCD panel.

Furthermore, an absolute value of the compensation value is equal to an absolute value of the offset value, which can correct the offset value and even remove the light spot.

Furthermore, the location of the pixel of the LCD panel and the corresponding compensation value of the pixel are prestored to a compensation table. When the LCD panel is driven to display, the corresponding compensation value is read from the compensation table, and is superimposed to display data of a corresponding display region, which avoids complicated calculation and improves response speed of the LCD panel.

Furthermore, each of the pixels comprises a plurality of sub-pixels, M sub-pixels are regarded as one display region, and each of the display regions corresponds to one jitter value. Display data of N sub-pixels in each of the display regions increases or reduces one minimum grey unit after the compensation value is superimposed. M and N are positive integers, N is less than M, and M is more than or equal to four. The brightness of the LCD panel is adjusted through the gray scale, and the minimum adjusting unit of each of the sub-pixels is one gray scale, however, single sub-pixel achieves that the gray scale is accurately adjusted, which increases costs and technology difficulty. Thus, in the present disclosure, the plurality of sub-pixels regarded as one display region to adjust, it is assumed that the brightness of M sub-pixels is same, and the brightness of one of the M sub-pixels adjusts one gray scale, at this time, the brightness of the one display region comprising M sub-pixels adjusts I/M gray scale. Thus, in a typical condition, very smooth and accurate brightness adjustment is obtained without increasing costs.

Furthermore, a transition region is formed through regarding adjacent M display regions as one unit, jitter values N of the M display regions in each of transition region are between 0 and M−1, which successively increases or decreases according to the location of the pixel of the LCD panel. If compensation brightness of two adjacent regions in the light spot is very small (such as one gray scale) but obvious boundary still exists between the two adjacent regions, which affects display quality of the LCD panel. At this time, a plurality of transition regions is set between the two adjacent regions. Because the transition region comprises a plurality of display regions, and the accurate brightness adjustment is performed in the display region, the brightness of the display region of the transition region gradually increases, which causes smooth brightness transition, hereby weakening the boundary of the two adjacent regions and improving display quality of the LCD panel.

Furthermore, if a difference value between the gray scales of two adjacent pixels in the light spot exceeds a preset threshold, M pixels is regarded as one display region, each of the display regions corresponds to one jitter value, display data of N pixels of each of the display regions increase or decrease one minimum gray scale unit after the compensation value is superimposed. M and N are positive integers, and N is less than M. The pixel is a basic imaging unit of the LCD panel, thus, it allowable that the display region regards the pixel as unit to compensate the brightness, which ensures integrality of the picture.

A driving circuit of a liquid crystal display (LCD) panel comprises a storage block storing a location of a pixel of the LCD panel and a corresponding compensation value, and a calculation block driving the LCD panel according to the location of the pixel of the LCD panel and the corresponding compensation value. The compensation value of the pixel corresponds to an offset value of a reference brightness corresponding to brightness of the light spot of the LCD panel before compensation of the light spot.

Furthermore, the storage block comprises a first storage cell storing the location of each of the pixels, and a second storage cell storing the compensation value of each of the pixels. The first storage cell uses an electrically erasable programmable read-only memory, and the second storage cell uses a static random access memory. An inter-integrated circuit ($I^2C$) interface cell and a location decoding cell is successively connected in series between the first storage cell and the calculation block, the $I^2C$ interface cell is used to read data of the first storage cell, the location decoding cell is used to decode the data of the first storage cell and sending the location data of the pixel to the calculation block. The calculation block further is coupled to a data receiving block, the second storage cell, and an interpolating calculation cell. The interpolating calculation cell is coupled to a video data sending block.

when power is provided, the first storage cell copies the compensation value of each of the pixels to the second storage cell, and the calculation block reads display data of the data receiving block. The display data of the data receiving block is compared with the location of the pixel output by the location decoding cell. If the location of the display data belongs to the location of the pixel corresponding to the light spot, the calculation block reads the compensation value of the corresponding pixel from the second storage cell, and superimposes the compensation value to the display data, and then sends superimposed data to the interpolating calculation cell.

If a difference value between gray scales of two adjacent sub-pixels in the light spot exceeds a preset threshold, M pixels is regarded as one display region, each of the display regions corresponds to one jitter value N, display data of N pixels of each of the display regions increases or decreases one minimum gray scale unit after the compensation value is superimposed. M and N are positive integers, and N is less than M, and M is more than or equal to four.

The brightness of the LCD panel is adjusted through the gray scale, and the minimum adjusting nit of each of the sub-pixels is one gray scale, however, single sub-pixel achieves that the gray scale is accurately adjusted, which increases costs and technology difficulty. Thus, in the present disclosure, the plurality of sub-pixels regarded as one display region to adjust, it is assumed that the brightness of M sub-pixels is same, and the brightness of one of the M sub-pixels adjusts one gray scale, at this time, the brightness of the one display region comprising M sub-pixels adjusts I/M gray scale. Thus, in a typical condition, very smooth and accurate brightness adjustment is obtained without increasing costs. Access speed to data of the SRAM is far greater than the EEPROM, thus the compensation value can be copied to the SRAM after the power is provided, and the calculation block may directly read the compensation value from the SRAM to calculate, which improves calculating rate, and allows to timely compensate the original video data to improve response speed of the LCD panel.

A method for compensating a light spot of a liquid crystal display (LCD) panel comprises: determining a compensation value of a pixel of the LCD panel according to an offset value between brightness of the pixel and a reference brightness, and storing the compensation value of the pixel and a location of the corresponding pixel into the LCD panel, and superimposing a corresponding compensation value onto display data of the pixel when the LCD panel outputs the display data of the pixel.

Furthermore, the locations of two pixels are determined, a difference value of between gray scales of the two pixels is a minimum gray scale unit, and distance between the two pixels is smallest. A number and the location of the pixel between the two pixels are determined. When the number of the pixel exceeds a threshold Y, a jitter value is calculated. A number of the pixel M is preset, and M is less than Y. The jitter value corresponding to each of the pixels, which is between the two pixels, is calculated, which allows the brightness between the two pixels to evenly transit through regarding M pixels as one display region. The brightness of the LCD panel is adjusted through the gray scale, and the minimum adjusting unit of each of the sub-pixels is one gray scale, however, single sub-pixel achieves that the gray scale is accurately adjusted, which increases costs and technology difficulty. Thus, in the present disclosure, the plurality of sub-pixels regarded as one display region to adjust, it is assumed that the brightness of M sub-pixels is same, and the brightness of one of the M sub-pixels adjusts one gray scale, at this time, the brightness of the one display region comprising M sub-pixels adjusts I/M gray scale. Thus, in a typical condition, very smooth and accurate brightness adjustment is obtained without increasing costs.

The brightness of the light spot of the LCD panel is greater than brightness of other regions of the LCD panel, thus finding the light spot of the LCD panel is easier. In the present disclosure, firstly, brightness of all pixels is compared with the reference brightness, and the offset value is generated. When the offset value exceeds a deviation range, one compensation value is added to a corresponding pixel to reduce the brightness of the corresponding pixel, which reduces the offset value between the brightness of the corresponding pixel and the reference brightness, thereby weakening the light spot and even removing the light spot.

In the present disclosure, according to the reference brightness (such as white picture of uniformity brightness of an entire LCD panel), only a region having the light spot is compensated. Calculating the light spot is according to the location and the brightness of the light spot, and the brightness of the pixel in the light spot or the brightness of the pixel of a defined display region is accurately compensated. Thus, in the present disclosure uses the offset value to determine the region of the light spot and then the calculation data is used to correct and compensate the brightness of the light spot without considering uniformity of the entire LCD panel, which simplifies calculation, reduces costs, and improves response speed of the LCD panel.

BRIEF DESCRIPTION OF FIGURES

FIG. 8 is a diagram of a table of storing location of the pixel of an example of the present disclosure.

DETAILED DESCRIPTION

The present disclosure provides a method for driving a liquid crystal display (LCD) panel and a method for compensating a light spot of the LCD panel.

Figure 1:
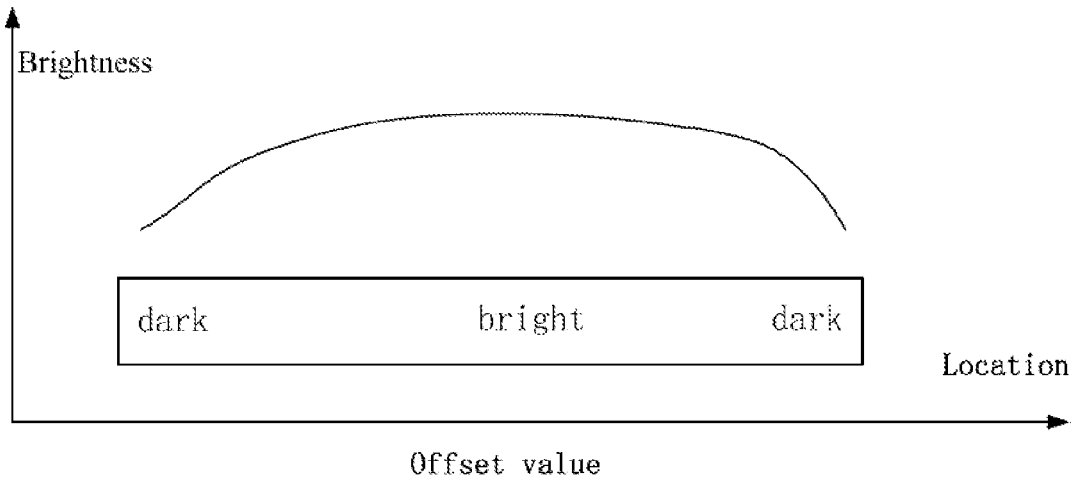
FIG. 1 (PRIOR ART)
FIG. 1 is a relation diagram of brightness and location of offset value of light spot of the prior art.
Figure 2:
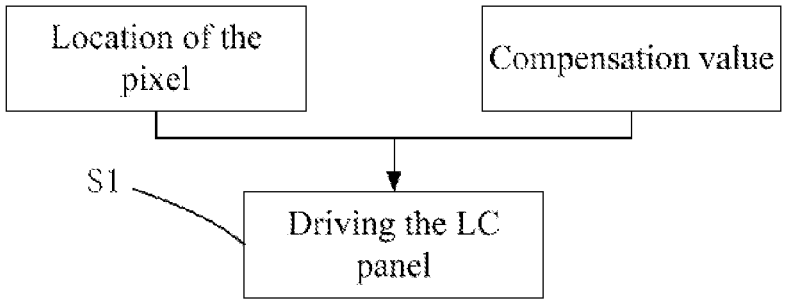
FIG. 2 is a flowchart of a method for driving a liquid crystal display (LCD) panel of the present disclosure.

As shown in FIG. 2, the method for driving the LCD panel comprises:

S1: driving the LCD panel according to a location of a pixel of the LCD panel and a corresponding compensation value of the pixel of the LCD panel. The compensation value of the pixel corresponds to an offset value of a reference brightness corresponding to brightness of the light spot of the LCD panel before compensation of the light spot.

Figure 3:
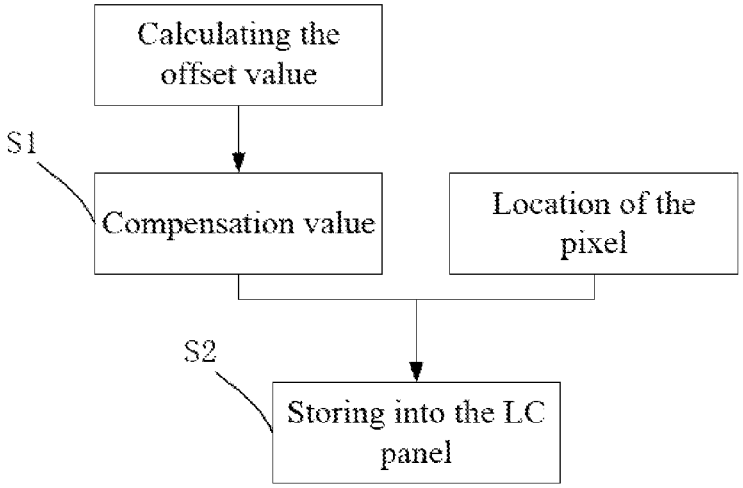
FIG. 3 is a flowchart of a method for compensating a light spot of the LCD panel of the present disclosure.

As shown in FIG. 3, the present disclosure comprises a method for compensating the light spot of the LCD panel before the method for driving the LCD panel, Where the method for compensating the light spot of the LCD panel comprises:

S1: determining the compensation value according to an offset value between brightness of the pixel of the LCD panel and the reference brightness.

S2: storing the compensation value of the pixel and a location of the corresponding pixel into the LCD panel, and superimposing the corresponding compensation value onto display data of the pixel when the LCD panel outputs the display data of the pixel.

Figure 4:
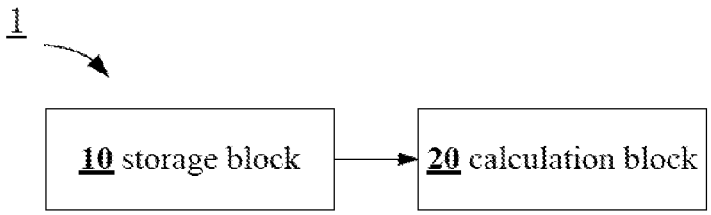
FIG. 4 is a block diagram of a driving circuit of the LCD panel of the present disclosure.

As shown in FIG. 4, the present disclosure provides a driving circuit 1 of the LCD panel comprising a storage block 10 storing the location of the pixel of the LCD panel and the compensation value of the pixel, and a calculation block 20 driving the LCD panel according to the location of the pixel and the compensation value of the pixel. The compensation value of the pixel corresponds to an offset value of a reference brightness corresponding to brightness of the light spot of the LCD panel before compensation of the light spot.

The brightness of the light spot of the LCD panel is greater than brightness of other regions of the LCD panel, thus finding the light spot of the LCD panel is easier. In the present disclosure, firstly, brightness of all pixels is compared with the reference brightness, and the offset value is generated. When the offset value exceeds a deviation range, one compensation value is added to a corresponding pixel to reduce the brightness of the corresponding pixel, which reduces the offset value between the brightness of the corresponding pixel and the reference brightness, thereby weakening he light spot and even removing the light spot. In the present disclosure, according to the reference brightness such as white picture of uniformity brightness of an entire LCD panel), only a region having the light spot is compensated. Calculating the light spot is according to the location and the brightness of the light spot, and the brightness of the pixel in the light spot or the brightness of the pixel of a defined display region is accurately compensated. Thus, in the present disclosure uses the offset value to determine the region of the light spot and then the calculation data is used to correct and compensate the brightness of the light spot without considering uniformity of the entire LCD panel, which simplifies calculation, reduces costs, and improves response speed.

The present disclosure will further be described in detail in accordance with the figures and the exemplary examples.

EXAMPLE 1

A method for driving an LCD panel comprises:

S1: driving the LCD panel according to the location of the pixel of the LCD panel and the corresponding compensation value of the pixel of the LCD panel. The compensation value of the pixel corresponds to an offset value of a reference brightness corresponding to brightness of the light spot of the LCD panel before compensation of the light spot.

Figure 5:
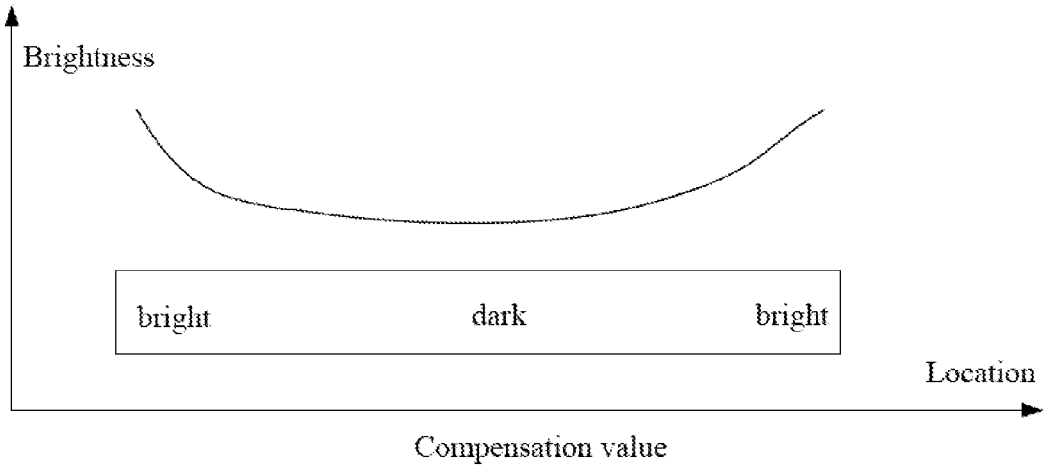
FIG. 5 is a relation diagram of brightness and location of compensation value of light spot of an example of the present disclosure.

An absolute value of the compensation value is equal to an absolute value of the offset value. As shown in FIG. 5, direction of the compensation value and direction of the offset value are opposite. The absolute value of the compensation value is equal to the absolute value of the offset value, which completely corrects the offset value, and removes the light spot, FIG. 6 is an effect diagram after compensation of the light spot.

Figures 6, 7:
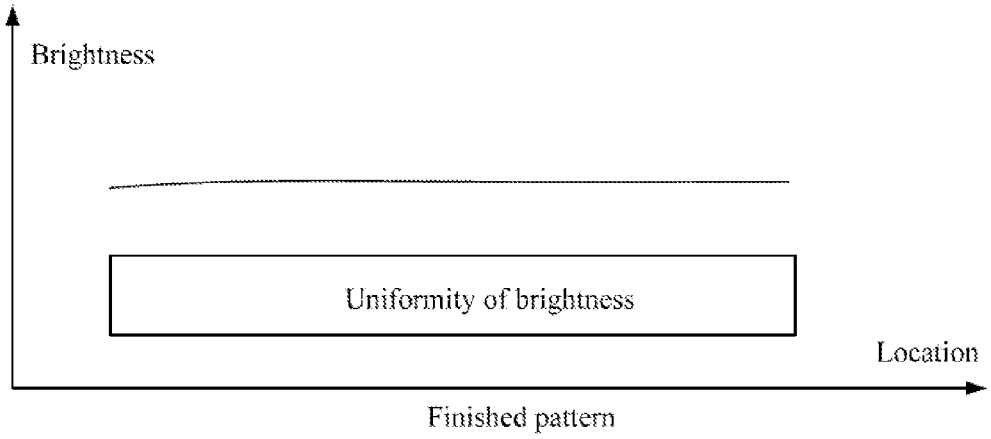
FIG. 6 is a relation diagram of brightness and location after compensation of light spot of an example of the present disclosure.
FIG. 7 is a diagram of a table of storing compensation value of light spot of an example of the present disclosure.

As shown in FIG. 7 and FIG. 8, the location and the compensation value of each of the pixels are prestored in a compensation table, when the LCD panel is driven, the compensation value is read from the compensation table and is superimposed to display data of a corresponding display region, which avoids complicated calculation and improves response speed of the LCD panel. The compensation table is stored into an electrically erasable programmable read-only memory (EEPROM), each of the pixels has 255 gray scales, and 8 gray scales together use one location and one compensation value o save storage space of the EEPROM.

Each of the pixels comprises a plurality of sub-pixels, M sub-pixels are regarded as one display region, and each of the display regions corresponds to one jitter value. Display data of N sub-pixels in each of the display regions increase or reduce one minimum grey unit after the compensation value is superimposed, where M and N are positive integers, N is less than M and M is more than or equal to four. The present disclosure is further described through taking M=4 for example.

Figure 9:
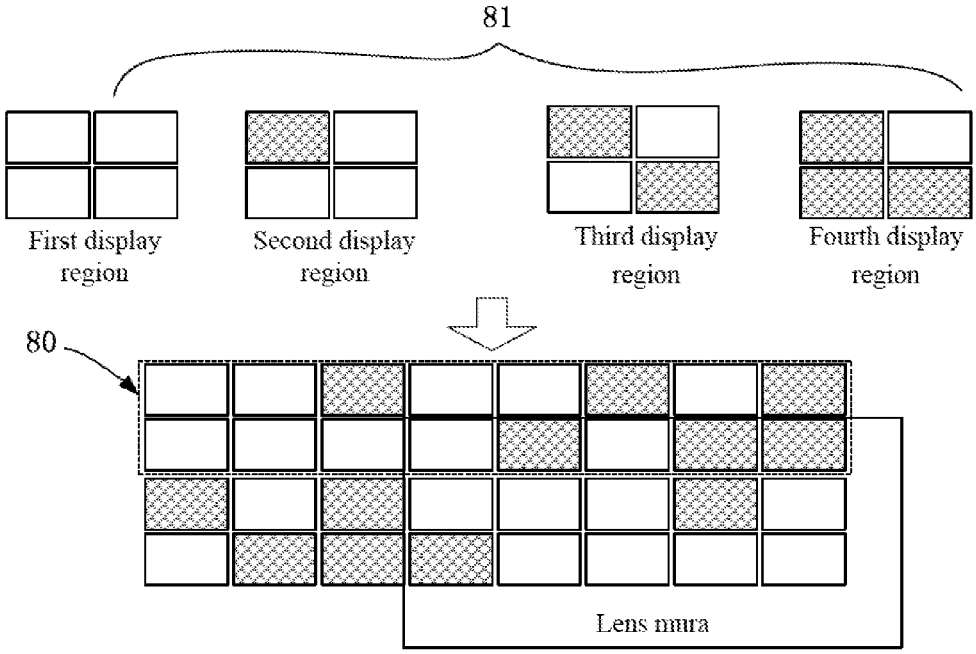
FIG. 9 is a schematic diagram of a display region and a transition region of an example of the present disclosure.

As shown in FIG. 9, four sub-pixels is regarded as one display region 81, and each of the display regions 81 corresponds to one jitter value N. Display data of N sub-pixels in each of the display regions increases or reduces one minimum grey unit after the compensation value is superimposed, where N is the positive integer, and N is less than four. The brightness of the LCD panel is adjusted through the gray scale, and the minimum adjusting, unit of each of the sub-pixels is one gray scale, however, single sub-pixel achieves that the gray scale is accurately adjusted, which increases costs and technology difficulty. Thus, in the present disclosure, the plurality of sub-pixels regarded as one display region 81 to adjust, it is assumed that the brightness of four sub-pixels is same and the brightness of one of the four sub-pixels adjusts one gray scale, at this time, the brightness of the one display region comprising four sub-pixels adjusts one fourth gray scale. Thus, in a typical condition, very smooth and accurate brightness adjustment is obtained without increasing costs.

A number of the sub-pixels regarded as one display region is determined by locations of two pixels, where a difference value between gray scales of the two pixels is a minimum gray scale unit, and distance between the two pixels is smallest. Firstly, a number and the location of the pixel between the two pixels are determined, when the number of the pixel exceeds a threshold Y, the jitter value is calculated.

A number of the pixel M is preset, and M is less than Y. The jitter value corresponding to each of the pixels is calculated, which allows the brightness between the two pixels to evenly transit through regarding M pixels as one display region, where a difference value between gray scales of the two pixels is a minimum gray scale unit, and the distance between the two pixels is smallest.

Suppose Y is equal to eight, and M is equal to four, two display regions are formed between the two pixels. Each of the two display regions corresponds to one jitter value, and it is better that two exemplary jitter values are different, which allows the brightness between the two pixels to smoothly transit. The jitter value and the compensation value are read in the LCD panel after the jitter value and the location of the pixel are determined. When the LCD panel is driven, if a sub-pixel displayed has the compensation value and the jitter value, display data of the sub-pixel displayed increases or reduces one minimum gray scale unit after the compensation value is superimposed to the display data of the sub-pixel displayed.

If compensation brightness of two adjacent regions in the light spot is very small (such as one gray scale), but obvious boundary still exists between the two adjacent regions, which affects display quality of the LCD panel. At this time, a plurality of transition regions 80 is set between the two adjacent regions. Because the transition region 80 comprises a plurality of the display regions 81, and the accurate brightness adjustment is performed in the display region 81 the brightness of the display region 81 of the transition region 80 gradually increases, which causes smooth brightness transition, thereby weakening the boundary of the two adjacent regions and improving display quality of the LCD panel.

Suppose the minimum compensation gray scale $\Delta_g$ of each of the sub-pixels is one gray scale, a current display gray scale is 51 gray scale, gray scale of three sub-pixels in a fourth display region of each of the transition regions 80 is 50 gray scale, gray scale of one sub-pixel in a fourth display region of each of the transition regions 80 is 51 gray scale, thus, the brightness of the fourth display region of the transition region 80 is 50.25 gray scale. In a same way, gray scale of two sub-pixels in a third display region 81 of each of the transition regions 80 is 50 gray scale, gray scale of two sub-pixels in the third display region 81 is the 51 gray scale, the brightness of the third display region of the transition legion 80 is 50.5 gray scale, and so on.

When the gray scale regarding location as a unit is compensated, the compensation is not fine and smooth because the compensation table records the gray scale of entire unit (for example, the compensation gray scale is the 51 gray scale in a location of 20 of the pixel, and the compensation gray scale is the 52 gray scale up to a location of 27 of the pixel, thus brightness of locations of 20-26 is compensated by the 51 gray scale, the compensation method is rough). The above-mentioned method of the display region 81 and the transition region 80 is used to allow obtaining fine and smooth compensation, in the method, a detailed gray scale distribution is formed through combination and simulation of the sub-pixel.

It should be understood that the number of the sub-pixel of each of the display regions of the present disclosure is not limited to four, as the number of the sub-pixel increases, control of the gray scale is better and smoother.

Figure 10:
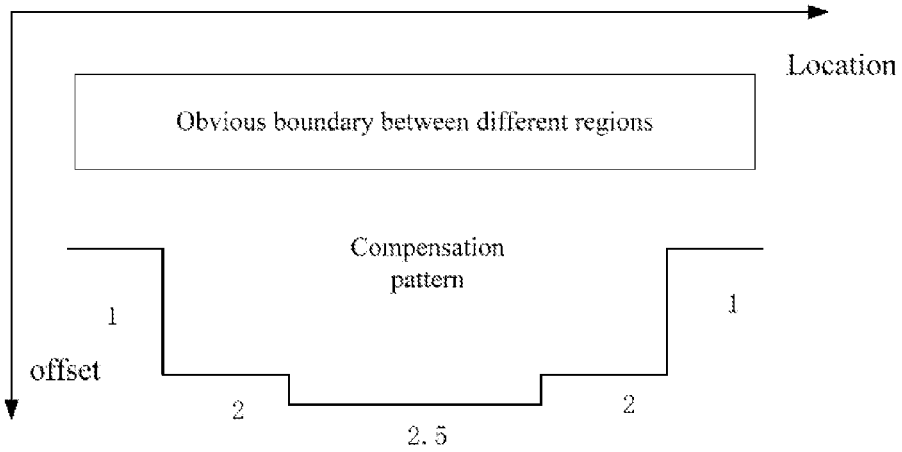
FIG. 10 is an effect diagram of compensating each of a plurality of pixels of the LCD panel of an example of the present disclosure.
Figure 11:
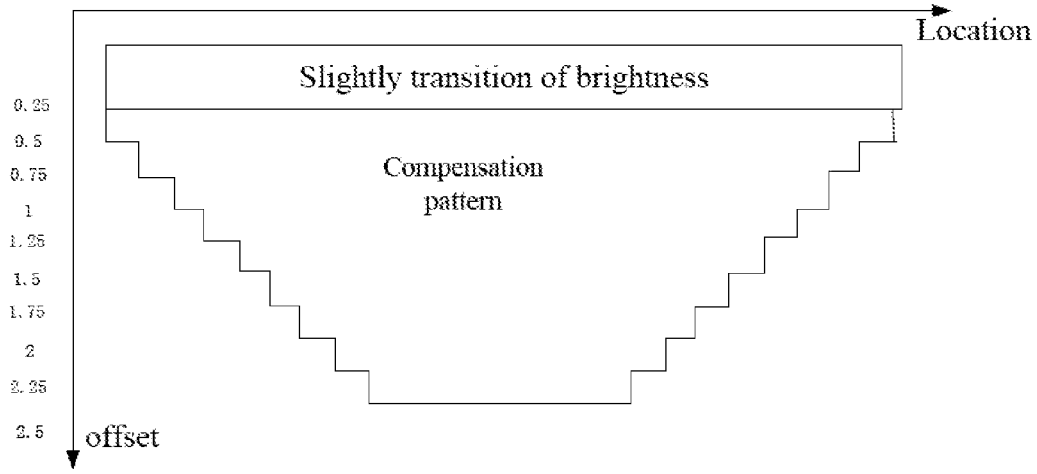
FIG. 11 is an effect diagram of compensating each of a plurality of display regions of an example of the present disclosure.

A minimum display unit of the LCD panel is the sub-pixel, in order to control. accurate and smooth brightness, each of the sub-pixels may correspond to one compensation value. The pixel is a basic imaging unit of the LCD panel, thus, it is allowable that the display region regards the pixel as unit to compensate the brightness, which ensures integrality of the picture. As shown in FIG. 10, a compensation method is used according to each of the pixels or each of the sub-pixels, boundary of different regions of the light spot is obvious. If an interpolating compensation method is used, the brightness in the light spot slightly changes, and the display effect is good, as shown in FIG. 11.

EXAMPLE 2

Figure 12:
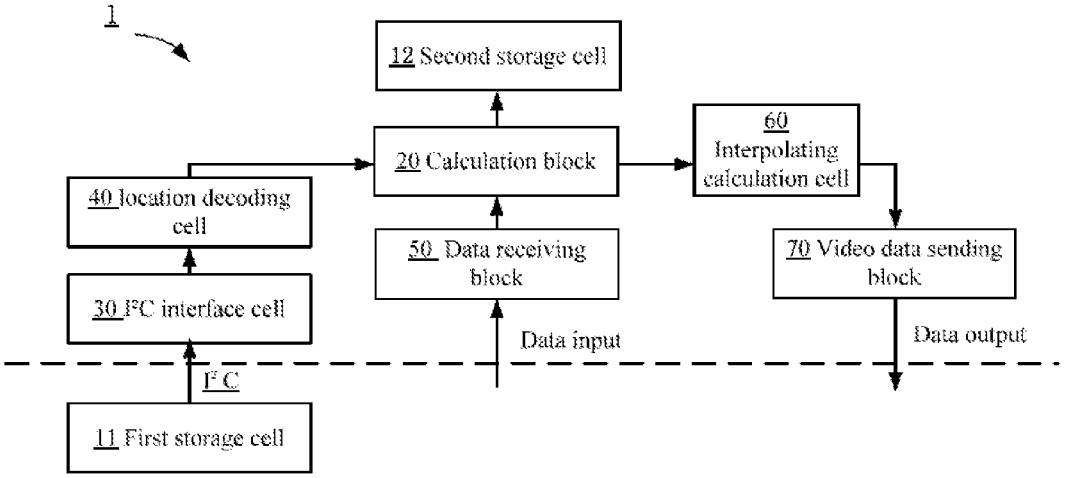
FIG. 12 is a schematic diagram of a driving circuit of the LCD panel of an example of the present disclosure.

As shown in FIG. 12, the present disclosure provides a driving circuit of a liquid crystal display (LCD) panel using a field-programmable gate array (FPGA). The driving circuit comprises the storage block and the calculation block, where the storage block comprises a first storage cell 11 storing a location of each of the pixels, and a second storage cell 12 storing a compensation value of each of the pixels. The first storage cell 11 use the EEPROM, and the second storage cell 12 uses a static random access memo SRAM). An inter-integrated circuit ($I^2C$) interface cell 30 and a location decoding cell 40 is successively connected in series between the first storage cell 11 and the calculation block 20, the $I^2C$ interface cell 30 is used to read data of the first storage cell 11, the location decoding cell 40 is used to decode the data of the first storage cell 11 and sending the location data of the pixel to the calculation block 20. The calculation block 20 is coupled to a data receiving block 50, the second storage cell 12, and an interpolating calculation cell 60. The interpolating calculation cell 60 is coupled to a video data sending block 70, and the video data sending block 70 sends a video data manipulated to a data line of the LCD panel.

When power is provided, the first storage cell 11 copies the compensation value of each of the pixels to the second storage cell 12, and the calculation block 20 reads display data of the data receiving block 50, where the display data of the data receiving block 50 is compared with the location of the pixel output by the location decoding cell 40. If the location of the display data belongs to the location of the pixel corresponding to the light spot, the calculation block 20 reads the compensation value of the corresponding pixel from the second storage cell 12, and superimposes the compensation value to the display data, and then sends the superimposed data to the interpolating calculation cell 60.

If a difference value of the gray scale between two adjacent sub-pixels in the light spot exceeds 0.25, and four sub-pixels is regarded as one display region, each of the display regions corresponds to one jitter value N, the interpolating calculation cell 60 increases or decreases one minimum gray scale unit after the compensation value is superimposed to the display data of N sub-pixels of each of the display regions, where N is the positive integer, and N is less than four.

The brightness of the LCD panel is adjusted through the gray scale, and the minimum adjusting unit of each of the sub-pixels is one gray scale, however, single sub-pixel achieves that the gray scale is accurately adjusted, which increases costs and technology difficulty. Thus, in the present disclosure, the plurality of sub-pixels regarded as one display region to adjust, it is assumed that the brightness of M sub-pixels is same, and the brightness of one of the M sub-pixels adjusts one gray scale, at this time, the brightness of the one display region comprising M sub-pixels adjusts 1/M gray scale. Thus, in a typical condition, very smooth and accurate brightness adjustment is obtained without increasing costs. Access speed to data of the SRAM is far greater than the EEPROM, thus the compensation value can be copied to the SRAM after the power is provided, and the calculation block may directly read the compensation value from the SRAM to calculate, which improves calculating rate, and allows to timely compensate the original video data to improve response speed of the LCD panel.

It should be understood that the number of the sub-pixel of each of the display regions of the present disclosure is not limited to four, as the number of the sub-pixel increases, control of the gray scale is better and smoother.

The minimum display unit of the LCD panel is the sub-pixel, in order to control accurate and smooth brightness, each of the sub-pixels may correspond to one compensation value. The pixel is regarded as the unit by the image, each of the pixels comprises three sub-pixel, thus, the pixel comprising three sub-pixels may corresponds to one compensation value.

The driving circuit of the present disclosure may use a microcontroller, a digital signal processor, and the like. The storage block is not limited to the EEPROM and SRAM.

The present disclosure is described in detail in accordance with the above contents with the specific exemplary examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong the protection scope of the present disclosure.

We claim:

1. A method for driving a liquid crystal display (LCD) panel, comprising:

driving the LCD panel and only outputting a compensation value to a pixel of a light spot of the LCD panel;

wherein the compensation value of the pixel of the LCD panel corresponds to an offset value of a reference brightness corresponding to brightness of a light spot of the LCD panel before compensation of the light spot of the LCD panel; and wherein each of the pixels of the LCD panel comprises a plurality of sub-pixels, M sub-pixels is regarded as one display region, and each of the display regions corresponds to one jitter value; display data of N sub-pixels in each of the display regions increase or reduce one minimum grey unit after the compensation value is superimposed; M and N are positive integers, N is less than M, and M is more than or equal to four; a transition region is formed through regarding adjacent m display regions as one unit, jitter values n of the m display regions in each of transition region are between 0 and m-1, which successively increases or decreases according to the location of the pixel of the LCD panel; and wherein the LCD panel is driven by a driving circuit, and the driving circuit comprises a storage block storing a location of a pixel of the LCD panel and a corresponding compensation value; and a calculation block driving the LCD panel and outputting the compensation value to a pixel of the light spot of the LCD panel, and the storage block comprises a first storage cell storing the location of each of the pixels of the LCD panel, and a second storage cell storing the compensation value of each of the pixels; the first storage cell uses an electrically erasable programmable read-only memory, and the second storage cell uses a static random access memory; an inter-integrated circuit (I2C) interface cell and a location decoding cell is successively connected in series between the first storage cell and the calculation block, the I2C interface cell is used to read data of the first storage cell, the location decoding cell is used to decode the data of the first storage cell and send the location data of the pixel to the calculation block; the calculation block further is coupled to a data receiving block, the second storage cell, and an interpolating calculation cell; the interpolating calculation cell is coupled to a video data sending block;

when power is provided, the first storage cell copies the compensation value of each of the pixels to the second storage cell, and the calculation block reads display data of the data receiving block; the display data of the data receiving block is compared with the location of the pixel output by the location decoding cell; if the location of the display data belongs to the location of the pixel corresponding to the light spot, the calculation block reads the compensation value of the corresponding pixel from the second storage cell, and superimposes the compensation value to the display data, and then sends superimposed data to the interpolating calculation cell;

if a difference value between the gray scales of two adjacent sub-pixels in the light spot exceeds a preset threshold, M pixels is regarded as one display region, each of the display regions corresponds to one jitter value n, display data of N pixels of each of the display regions increases or decreases one minimum gray scale unit after the compensation value is superimposed; M and N are positive integers, and N is less than M, and M is more than or equal to four.

2. A driving circuit of a liquid crystal display (LCD) panel, comprising:

a storage block storing a location of a pixel of the LCD panel and a corresponding compensation value; and a calculation block driving the LCD panel and only outputting a compensation value to a pixel of a light spot of the LCD panel;

wherein the compensation value of the pixel corresponds to an offset value of a reference brightness corresponding to brightness of a light spot of the LCD panel before compensation of the light spot; and wherein the storage block comprises a first storage cell storing the location of each of the pixels of the LCD panel, and a second storage cell storing the compensation value of each of the pixels; the first storage cell uses an electrically erasable programmable read-only memory, and the second storage cell uses a static random access memory; an inter-integrated circuit ($I^2C$) interface cell and a location decoding cell is successively connected in series between the first storage cell and the calculation block, the $I^2C$ interface cell is used to read data of the first storage cell, the location decoding cell is used to decode the data of the first storage cell and send the location data of the pixel to the calculation block; the calculation block further is coupled to a data receiving block, the second storage cell, and an interpolating calculation cell; the interpolating calculation cell is coupled to a video data sending block;

when power is provided, the first storage cell copies the compensation value of each of the pixels to the second storage cell, and the calculation block reads display data of the data receiving block; the display data of the data receiving block is compared with the location of the pixel output by the location decoding cell; if the location of the display data belongs to the location of the pixel corresponding to the light spot, the calculation block reads the compensation value of the corresponding pixel from the second storage cell, and superimposes the compensation value to the display data, and then sends superimposed data to the interpolating calculation cell;

if a difference value between the gray scales of two adjacent sub-pixels in the light spot exceeds a preset threshold, M pixels is regarded as one display region, each of the display regions corresponds to one jitter value n, display data of N pixels of each of the display regions increases or decreases one minimum gray scale unit after the compensation value is superimposed; M and N are positive integers, and N is less than M, and M is more than or equal to four.

3. A method for compensating light spot of a liquid crystal display (LCD) panel, comprising:

determining a compensation value of a pixel of the LCD panel according to an offset value between brightness of the pixel and a reference brightness; and storing the compensation value of the pixel and a location of the corresponding pixel into the LCD panel, and superimposing the corresponding compensation value onto display data of a light spot of the pixel of the LCD panel when the LCD panel outputs the display data of the pixel; and wherein the LCD panel is compensated by a driving circuit, and the driving circuit comprises a storage block storing a location of a pixel of the LCD panel and a corresponding compensation value; and a calculation block driving the LCD panel and outputting the compensation value to a pixel of the light spot of the LCD panel, and the storage block comprises a first storage cell storing the location of each of the pixels of the LCD panel, and a second storage cell storing the compensation value of each of the pixels; the first storage cell uses an electrically erasable programmable read-only memory, and the second storage cell uses a static random access memory;

an inter-integrated circuit (I2C) interface cell and a location decoding cell is successively connected in series between the first storage cell and the calculation block, the I2C interface cell is used to read data of the first storage cell, the location decoding cell is used to decode the data of the first storage cell and send the location data of the pixel to the calculation block; the calculation block further is coupled to a data receiving block, the second storage cell, and an interpolating calculation cell; the interpolating calculation cell is coupled to a video data sending block;

when power is provided, the first storage cell copies the compensation value of each of the pixels to the second storage cell, and the calculation block reads display data of the data receiving block; the display data of the data receiving block is compared with the location of the pixel output by the location decoding cell; if the location of the display data belongs to the location of the pixel corresponding to the light spot, the calculation block reads the compensation value of the corresponding pixel from the second storage cell, and superimposes the compensation value to the display data, and then sends superimposed data to the interpolating calculation cell;

if a difference value between the gray scales of two adjacent sub-pixels in the light spot exceeds a preset threshold, M pixels is regarded as one display region, each of the display regions corresponds to one jitter value n, display data of N pixels of each of the display regions increases or decreases one minimum gray scale unit after the compensation value is superimposed; M and N are positive integers, and N is less than M, and M is more than or equal to four.

* * * * *